US010544997B2

(12) United States Patent
DeLugan

(10) Patent No.: US 10,544,997 B2
(45) Date of Patent: Jan. 28, 2020

(54) ANGLED FLUID REDISTRIBUTION SLOT IN HEAT EXCHANGER FIN LAYER

(71) Applicant: Hamilton Sundstrand Corporation, Charlotte, NC (US)

(72) Inventor: Anthony DeLugan, Agawam, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/923,161

(22) Filed: Mar. 16, 2018

(65) Prior Publication Data

US 2019/0285360 A1 Sep. 19, 2019

(51) Int. Cl.
*F28F 3/02* (2006.01)
*F28F 3/08* (2006.01)
*F28D 9/00* (2006.01)

(52) U.S. Cl.
CPC ..... *F28F 3/027* (2013.01); *F28D 9/0093* (2013.01); *F28F 3/08* (2013.01)

(58) Field of Classification Search
CPC ... F28D 9/0068; F28F 9/0075; F28F 2225/00; F28F 2225/04
USPC ..... 165/166, 167, 906
See application file for complete search history.

(56) References Cited

U.S. PATENT DOCUMENTS 3,196,942 A * 7/1965 Prentiss ..... F28D 9/0068 165/166
3,380,517 A * 4/1968 Butt ..... A01B 11/00 165/139
3,490,522 A * 1/1970 Bizzarro ..... F28F 3/025 165/166
4,282,927 A * 8/1981 Simmons ..... F28F 3/027 165/166
4,473,111 A * 9/1984 Steeb ..... F28D 9/0062 165/153
4,862,952 A * 9/1989 Tarasewich ..... F28D 9/0068 165/54
8,276,654 B2 * 10/2012 Zaffetti et al. ..... F28D 9/0062 165/166
8,327,924 B2 * 12/2012 Muley ..... F28F 3/02 165/135
9,279,626 B2 3/2016 Berukhim et al.
2005/0121181 A1 * 6/2005 Szulman ..... F25J 3/04412 165/166
2007/0056721 A1 * 3/2007 Usui ..... F28D 7/1684 165/183
2011/0180242 A1 * 7/2011 Urata ..... F28D 9/0068 165/166
2017/0023311 A1 1/2017 Urbanski

FOREIGN PATENT DOCUMENTS

EP 2161528 A2 3/2010

* cited by examiner

*Primary Examiner* — Allen J Flanigan
(74) *Attorney, Agent, or Firm* — Kinney & Lange, P.A.

(57) ABSTRACT

A heat exchanger core includes a first sheet having a first side and a second side opposite to the first side, a second sheet opposing the first side of the first sheet, and a first fin extending between the first side of the first sheet and the second sheet. The first fin defines first channels that extend in a first direction, the first fin including a first slot that extends at a first angle between thirty degrees and sixty degrees from the first direction and fluidly connects at least two of the first channels together.

18 Claims, 3 Drawing Sheets

ANGLED FLUID REDISTRIBUTION SLOT IN HEAT EXCHANGER FIN LAYER

BACKGROUND

Cross-flow heat exchangers are comprised of a series of layers that alternate between cold and hot, with the cold fluid flowing one direction and the hot fluid flowing another direction. The cold and hot fluids are kept separate but are in close proximity to one another in order to facilitate heat transfer. Therefore, some of the structures in cross-flow heat exchangers are constructed without excess bulk so they have relatively low strength. In order to handle the stresses due to thermal gradients that are present during operation of a cross-flow heat exchanger, reinforcement components can be added, although these oftentimes add unnecessary material and/or disrupt the flow of the cold and/or hot fluid.

SUMMARY

According to one embodiment, a heat exchanger core includes a first sheet having a first side and a second side opposite to the first side, a second sheet opposing the first side of the first sheet, and a first fin extending between the first side of the first sheet and the second sheet. The first fin defines first channels that extend in a first direction, the first fin including a first slot that extends at a first angle between thirty degrees and sixty degrees from the first direction and fluidly connects at least two of the first channels together.

According to another embodiment, a heat exchanger core includes a first layer including first channels extending in a first direction and a slot that extends across only a some of the first channels, the first slot extending at a first angle between thirty degrees and sixty degrees from the first direction and fluidly connects at least two of the first channels. A second layer is adjacent to the first layer, and the second layer includes second channels extending in a second direction that is different from the first direction.

DETAILED DESCRIPTION

Figure 1:
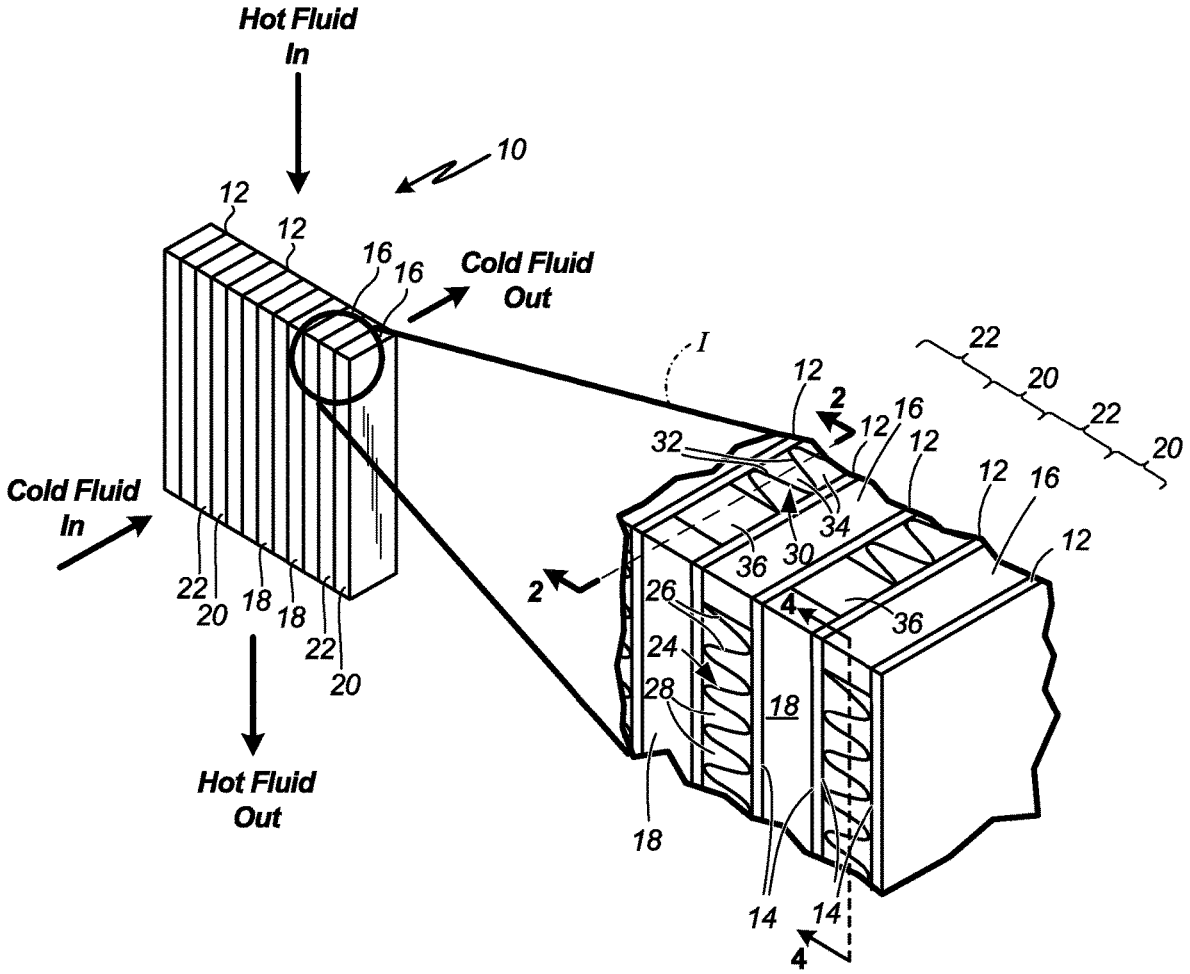
FIG. 1 is a perspective view of a cross-flow heat exchanger core including close-up inset I.

FIG. 1 is a perspective view of cross-flow heat exchanger core 10 including close-up inset I. In the illustrated embodiment, core 10 is comprised of a plurality of parallel parting sheets 12 each with two faces 14 that oppose faces 14 of the adjacent parting sheets 12. Positioned between alternating pairs of parting sheets 12 are cold closure bars 16, and positioned between the remaining pairs of parting sheets 12 are hot closure bars 18. Cold closure bars 16 are positioned along two opposing edges of core 10, and hot closure bars 18 are positioned along the other two opposing edges of core 10. Thereby, core 10 has a layered architecture that is comprised of a cold layers 20 alternating with hot layers 22. Each cold layer 20 includes two adjacent parting sheets 12 and a pair of cold closure bars 16, and each hot layer 22 includes two adjacent parting sheets 12 and a pair of hot closure bars 18, wherein each cold layer 20 shares parting sheets 12 with hot layers 22.

Within each cold layer 20 is a ruffled cold fin 24. Cold fin 24 is a corrugated sheet with a plurality of cold segments 26 that extend between and is brazed to the corresponding parting sheets 12. Thereby, each cold layer 20 is divided into a plurality of cold channels 28 by the plurality of cold segments 26. The plurality of cold channels 28 extend parallel to cold closure bars 16.

Within each hot layer 22 is a ruffled hot fin 30. Hot fin 30 is a corrugated sheet with a plurality of hot segments 32 that extend between and is brazed to the corresponding parting sheets 12. Thereby, each hot layer 22 is divided into a plurality of hot channels 34 by the plurality of hot segments 32. The plurality of hot channels 34 extend parallel to hot closure bars 18. In the illustrated embodiment, core 10 the shape of a rectangular prism, so hot channels 34 extend perpendicularly to cold channels 28. Also within each hot layer 22 is a reinforcing bar 36. Reinforcing bars 36 extend between and are brazed to the corresponding parting sheets 12 for increasing the rigidity of core 10.

During operation of cross-flow heat exchanger core 10, a cold fluid (not shown) is flowed through cold channels 28 while a hot fluid (not shown) is flowed through hot channels 34. Fins 24 and 30 and parting sheets 12 allow heat to be transferred from the hot fluid to the cold fluid, cooling the hot fluid and warming the cold fluid.

Figure 2:
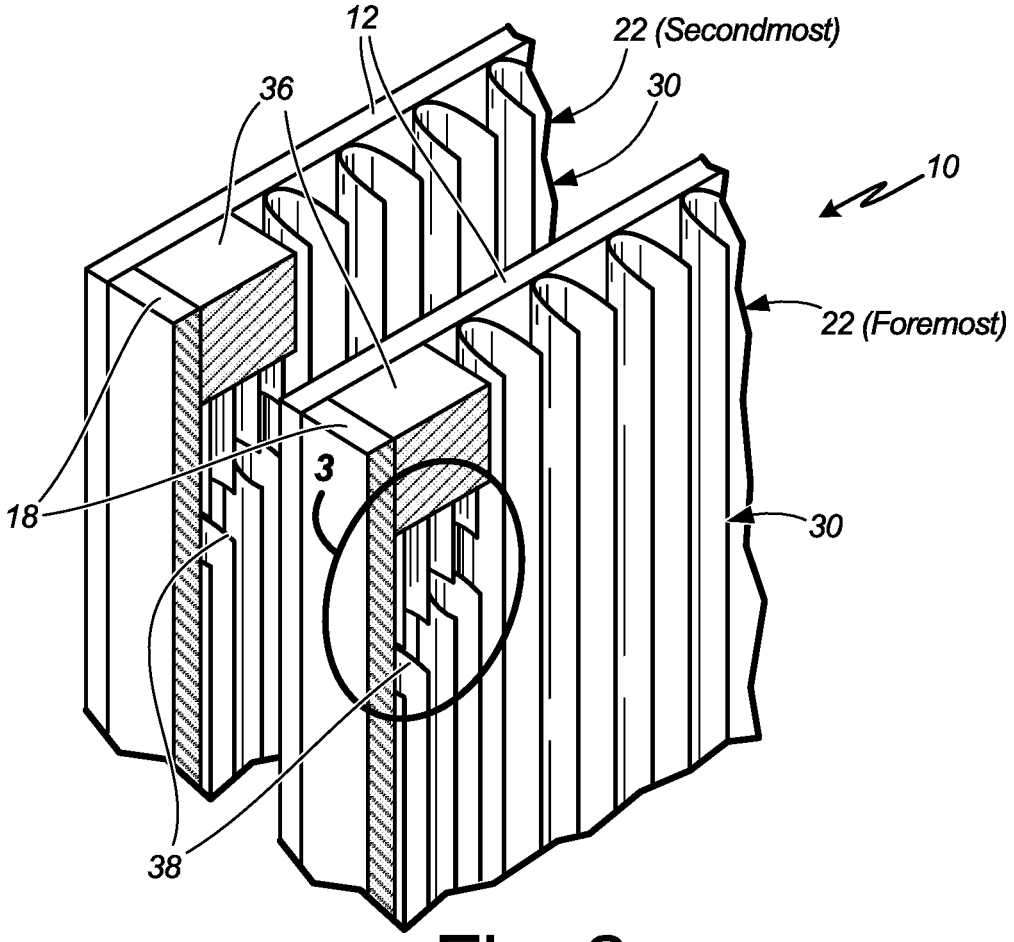
FIG. 2 is a perspective cross-sectional view of a hot layer of the cross-flow heat exchanger core taken along line 2-2 in FIG. 1.
Figure 3:
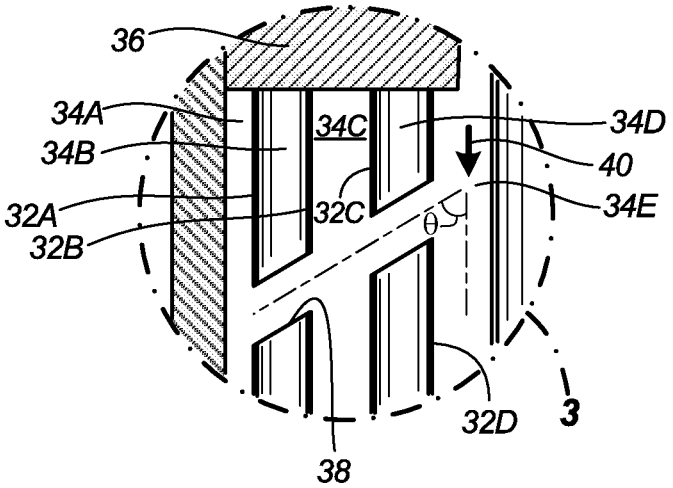
FIG. 3 is a front cross-sectional view of a portion of the hot layer denoted by circle 3 in FIG. 2.

FIG. 2 is a perspective cross-sectional view of the foremost hot layer 22 of cross-flow heat exchanger core 10 taken along line 2A-2A in FIG. 1. FIG. 2 also includes a perspective cross-sectional view of the second most hot layer 22 of cross-flow heat exchanger core 10 taken along line 2B-2B in FIG. 1, with the foremost cold layer 20 removed. FIG. 3 is a front cross-sectional view of a portion of the foremost hot layer 22 denoted by circle 3 in FIG. 2. FIGS. 2 and 3 will now be discussed simultaneously, although only one of the two visible slots 38 is shown in detail.

In the illustrated embodiment, each hot fin 30 includes slot 38, which is a cut through the entire depth of each of hot segments 32A-32D. Slot 38 extends at angle θ with respect to flow direction 40, wherein angle θ is between thirty and sixty degrees (and is shown as being forty-five degrees). Slot 38 is positioned partially downstream of reinforcing bar 36, and fluidly connects hot channels 34A-34E. Because reinforcing bar 36 blocks hot channels 34A-34D from receiving flow of hot fluid through the end of core 10, slot 38 allows the flow of hot fluid from channel 34E to reach hot channels 34A-34D. This lessens the fluid resistance of core 10, and therefore increases the efficiency of core 10. These effects are increased because of the downstream angle θ of slot 38 because there is a smoother transition of flow from channel 34E into channels 34A-34D. In addition, slot 38 being separated from reinforcing bar 36 allows hot fin 30 to remain a single piece.

Shown in FIGS. 2 and 3 is one embodiment of core 10, to which there are alternative embodiments. For example, slot 38 can extend farther toward the center of core 10, allowing flow from additional hot channels 34 to flow into hot channels 34A-34D. For another example, slot 38 can extend only partially through the depth of each of hot segments 32A-32D. For another example, slot 38 can narrow from hot channel 34E toward hot channel 34A. For another example, reinforcing bar 36 and slot 38 can be positioned in a cold layer 20 (shown in FIG. 1), and in such an embodiment, flow direction 40 would be oriented to correspond to the flow direction within cold layer 20 (which, in the illustrated embodiment, would be ninety degrees from flow direction 40 in hot layer 22). In addition, there can be a slot 38 in each layer 20 or 22 which includes a reinforcing bar 36.

Figure 4:
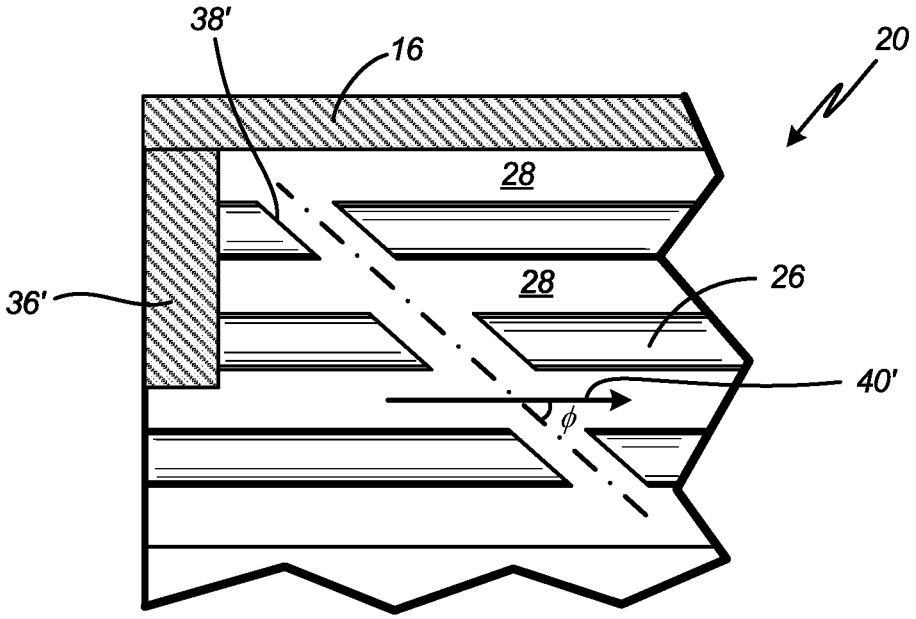
FIG. 4 is a front cross-sectional view of a portion of the cold layer of the cross-flow heat exchanger core taken along line 4-4 in FIG. 1.

FIG. 4 is a front cross-sectional view of a portion of cold layer 20 of core 10 taken along line 4-4 in FIG. 1. Shown in FIG. 4 is cold closure bar 16, cold layer 20, cold segments 26, cold channels 28, reinforcing bar 36', cold channel slot 38', and cold flow direction 40'. Cold channel slot 38' is positioned downstream of a cold channel reinforcing bar 36', similar to that described above with regard to slot 38 in hot layer 22. Cold channel slot 38' extends at angle $\phi$ with respect to cold channel flow direction 40', wherein angle $\phi$ is between thirty and sixty degrees (and is shown as being forty-five degrees). As shown in FIGS. 1, 3, and 4, cold channels 28 are approximately perpendicular to hot channels 34. Accordingly, cold channel flow direction 44 is approximately perpendicular to flow direction 40 in hot channels 34.

Discussion of Possible Embodiments

The following are non-exclusive descriptions of possible embodiments of the present invention.

A heat exchanger core according to an exemplary embodiment of this disclosure, among other possible things includes: a first sheet having a first side and a second side opposite to the first side; a second sheet opposing the first side of the first sheet; and a first fin extending between the first side of the first sheet and the second sheet, the first fin defining a first plurality of channels that extend in a first direction, the first fin including a first slot that extends at a first angle between thirty degrees and sixty degrees from the first direction and fluidly connects at least two of the first plurality of channels together.

The heat exchanger core of the preceding paragraph can optionally include, additionally and/or alternatively, any one or more of the following features, configurations and/or additional components:

A further embodiment of the foregoing heat exchanger core, wherein the first slot can extend at the angle of forty-five degrees.

A further embodiment of any of the foregoing heat exchanger cores, wherein the heat exchanger core can further comprise: a reinforcing bar extending between the first side of the first sheet and the second sheet.

A further embodiment of any of the foregoing heat exchanger cores, wherein the first slot can be positioned partially downstream of the reinforcing bar.

A further embodiment of any of the foregoing heat exchanger cores, wherein the first slot can extend through multiple channels that are not downstream of the reinforcing bar.

A further embodiment of any of the foregoing heat exchanger cores, wherein the first fin can comprise a plurality of segments, with each segment extending from one of the first sheet and the second sheet to the other of the first sheet and the second sheet, and wherein the first slot extends through the entire depth of some of the plurality of segments.

A further embodiment of any of the foregoing heat exchanger cores, wherein the first fin can comprise a plurality of segments, with each segment extending from one of the first sheet and the second sheet to the other of the first sheet and the second sheet, and wherein the first slot extends only partially through the depth of some of the plurality of segments.

A further embodiment of any of the foregoing heat exchanger cores, wherein the heat exchanger core can further comprise: a third sheet; and a second fin extending between the second side of the first sheet and the third sheet, the second fin defining a second plurality of channels that extend in a second direction, the second fin including a second slot that extends at a second angle between thirty degrees and sixty degrees from the second direction.

A further embodiment of any of the foregoing heat exchanger cores, wherein the first direction can be perpendicular to the second direction.

A further embodiment of any of the foregoing heat exchanger cores, wherein the heat exchanger core can further comprise: a reinforcing bar extending between the second side of the first sheet and the third sheet.

A heat exchanger core according to an exemplary embodiment of this disclosure, among other possible things includes: a first layer including a first plurality of channels extending in a first direction and a first slot that extends across only a some of the first plurality of channels, the first slot extending at a first angle between thirty degrees and sixty degrees from the first direction and fluidly connects at least two of the first plurality of channels; and a second layer adjacent to the first layer, the second layer including a second plurality of channels extending in a second direction that is different from the first direction.

The heat exchanger core of the preceding paragraph can optionally include, additionally and/or alternatively, any one or more of the following features, configurations and/or additional components:

A further embodiment of the foregoing heat exchanger core, wherein the first slot can extend at the angle of forty-five degrees.

A further embodiment of any of the foregoing heat exchanger cores, wherein the first layer can further comprise: a reinforcing bar extending across the first layer.

A further embodiment of any of the foregoing heat exchanger cores, wherein the first slot can be positioned partially downstream of the reinforcing bar.

A further embodiment of any of the foregoing heat exchanger cores, wherein the first slot can extend through multiple channels that are not downstream of the reinforcing bar.

A further embodiment of any of the foregoing heat exchanger cores, wherein the first layer can be a hot layer and the second layer can be a cold layer.

A further embodiment of any of the foregoing heat exchanger cores, wherein the first direction can be perpendicular to the second direction.

A further embodiment of any of the foregoing heat exchanger cores, wherein the second layer can include a second slot across only some of the second plurality of channels.

A further embodiment of any of the foregoing heat exchanger cores, wherein the second layer can include a reinforcing bar extending across the second layer.

A further embodiment of any of the foregoing heat exchanger cores, wherein the second slot can be positioned partially downstream of the reinforcing bar.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger core comprising:

a first sheet having a first side and a second side opposite to the first side;

a second sheet opposing the first side of the first sheet;

a closure bar between the first side of the first sheet and the second sheet;

a reinforcing bar abutting the closure bar and extending from the closure bar between the first side of the first sheet and the second sheet; and a first fin extending between the first side of the first sheet and the second sheet, the first fin defining a first plurality of channels that extend in a first direction, each of the first plurality of channels defining a channel inlet, the first fin including a first slot that extends at a first angle between thirty degrees and sixty degrees from the first direction and fluidly connects at least two of the first plurality of channels downstream of the reinforcing bar;

wherein:

the reinforcing bar blocks the channel inlets of the at least two of the first plurality of channels downstream of the reinforcing bar; and the first slot fluidly connects the at least two of the first plurality of channels with at least one unblocked channel.

2. The heat exchanger core of claim 1, wherein the first slot extends at the angle of forty-five degrees from the first direction.

3. The heat exchanger core of claim 1, wherein the first slot is positioned partially downstream of the reinforcing bar.

4. The heat exchanger core of claim 3, wherein the first slot extends through multiple channels that are not downstream of the reinforcing bar.

5. The heat exchanger core of claim 1, wherein the first fin comprises a plurality of segments, with each segment extending from one of the first sheet and the second sheet to the other of the first sheet and the second sheet, and wherein the first slot extends through the entire depth of some of the plurality of segments.

6. The heat exchanger core of claim 1, wherein the first fin comprises a plurality of segments, with each segment extending from one of the first sheet and the second sheet to the other of the first sheet and the second sheet, and wherein the first slot extends only partially through the depth of some of the plurality of segments.

7. The heat exchanger core of claim 1, further comprising:

a third sheet; and a second fin extending between the second side of the first sheet and the third sheet, the second fin defining a second plurality of channels that extend in a second direction, the second fin including a second slot that extends at a second angle between thirty degrees and sixty degrees from the second direction.

8. The heat exchanger core of claim 7, wherein the first direction is perpendicular to the second direction.

9. The heat exchanger core of claim 7, further comprising:

a reinforcing bar extending between the second side of the first sheet and the third sheet.

10. A heat exchanger core comprising:

a first layer including:

a first plurality of channels, each defining a channel inlet, the first plurality of channels extending in a first direction;

a closure bar adjacent to the first plurality of channels;

a reinforcing bar abutting the closure bar and extending across the first layer; and a first slot that extends across only a some of the first plurality of channels, the first slot extending at a first angle between thirty degrees and sixty degrees from the first direction and fluidly connects at least two of the first plurality of channels downstream of the reinforcing bar; and a second layer adjacent to the first layer, the second layer including a second plurality of channels extending in a second direction that is different from the first direction;

wherein:

the reinforcing bar blocks the channel inlets of the at least two of the first plurality of channels downstream of the reinforcing bar; and the first slot fluidly connects the at least two of the first plurality of channels with at least one unblocked channel.

11. The heat exchanger core of claim 10, wherein the first slot extends at the angle of forty-five degrees from the first direction.

12. The heat exchanger core of claim 10, wherein the first slot is positioned partially downstream of the reinforcing bar.

13. The heat exchanger core of claim 12, wherein the first slot extends through multiple channels that are not downstream of the reinforcing bar.

14. The heat exchanger core of claim 10, wherein the first layer is configured to receive a hot fluid and the second layer is configured to receive a cold fluid.

15. The heat exchanger core of claim 10, wherein the first direction is perpendicular to the second direction.

16. The heat exchanger core of claim 10, wherein the second layer includes a second slot across only some of the second plurality of channels.

17. The heat exchanger core of claim 16, wherein the second layer includes a reinforcing bar extending across the second layer.

18. The heat exchanger core of claim 17, wherein the second slot is positioned partially downstream of the reinforcing bar.

* * * * *